US010772407B2

(12) United States Patent
Yan et al.

(10) Patent No.: US 10,772,407 B2
(45) Date of Patent: Sep. 15, 2020

(54) HAIR DRYER DEFLECTOR

(71) Applicant: Jason Yan, New Taipei (TW)

(72) Inventors: Jason Yan, New Taipei (TW); Wen-Lung Kan, New Taipei (TW)

(73) Assignee: Jason Yan, New Taipei (TW)

( * ) Notice: Subject to any disclaimer, the term of this patent is extended or adjusted under 35 U.S.C. 154(b) by 160 days.

(21) Appl. No.: 16/122,813

(22) Filed: Sep. 5, 2018

(65) Prior Publication Data

US 2019/0380467 A1 Dec. 19, 2019

(30) Foreign Application Priority Data

Jun. 19, 2018 (TW) ..... 107208176 U

(51) Int. Cl.
*A45D 20/12* (2006.01)

(52) U.S. Cl.
CPC ..... *A45D 20/12* (2013.01); *A45D 2200/00* (2013.01)

(58) Field of Classification Search
USPC ..... 34/96, 283; 219/222
See application file for complete search history.

(56) References Cited

U.S. PATENT DOCUMENTS

2011/0197466 A1* 8/2011 Shami ..... A45D 20/12 34/283
2015/0335128 A1* 11/2015 Larkin ..... A45D 20/10 34/553
2016/0025107 A1* 1/2016 Pettitt ..... F04D 25/082 416/93 R

FOREIGN PATENT DOCUMENTS

GB 2401911 A * 11/2004 ..... F04D 25/084

* cited by examiner

*Primary Examiner* — John P McCormack
(74) *Attorney, Agent, or Firm* — Chun-Ming Shih

(57) ABSTRACT

The present invention is a hair dryer deflector, which comprises a power unit and an airflow generating unit. The airflow generating unit is connected to one side of the power unit, a plurality of perforations is disposed at the positions of the airflow generating unit relative to the power unit. The airflow generating unit is driven by the power unit to rotate to generate airflow, and the airflow flows through each of the perforations to flow toward the power unit and toward an air outlet of the hair dryer.

8 Claims, 5 Drawing Sheets

HAIR DRYER DEFLECTOR

BACKGROUND OF THE INVENTION

Field of Invention

The present invention relates to a deflector and more particularly to a hair dryer deflector.

Description of Related Art

As shown in FIG. 1, the figure is a perspective view of the current hair dryer. It can be seen from the figure that, a hair dryer 1 sucks air through a fan 11 from an air inlet 13 of a casing 12 into the casing 12. After the air is raised in temperature by a heating device in the casing 12, it is blown outward through an air outlet 14 of the casing 12 to provide functions such as drying or shaping to the hair.

All the hair dryers currently on the market focus on the intensity of the wind, heating effect or exterior design to enhance the value of the products. However, the traditional hair dryers still have some problems in use. For example, as shown in FIG. 2, which is a schematic diagram of a connection between a vertical motor and fan blades of a conventional hair dryer. The high speed rotation of a motor 20 of the current hair dryer will drive a blade 21 of the fan to rotate, thereby generating the heated gas that flows out through a heating device and an outlet of the hair dryer.

However, when the conventional hair dryer is continuously used for a long time, the internal temperature of the motor 20 continues to rise, and the heat generated by the heating device causes the motor 20 lacking a good diversion structure to be damaged often due to ineffective diversion.

SUMMARY OF THE INVENTION

In view of the above-mentioned problems in the prior art, the currently available hair dryer 1 to be equipped with a fan with a good diversion structure should be urgently needed.

According to an objective of the present invention, the present invention provides a hair dryer deflector, comprising: a power unit; and an airflow generating unit, the airflow generating unit being connected to one side of the power unit, a plurality of perforations being disposed at the positions of the airflow generating unit relative to the power unit, the airflow generating unit being driven by the power unit to rotate to generate airflow, and the airflow passing through each of the perforations to flow toward the power unit and toward an air outlet of the hair dryer.

Wherein the airflow generating unit comprises an upper ring, a lower disk and a plurality of fan blades, the fan blades are disposed between the upper ring and the lower disk, and a protrusion is disposed at the center of the lower disk, each of the perforations is surroundingly disposed around the protrusion.

Wherein the protrusion is disposed with a plurality of diversion blocks radially extending from the center of the lower disk, and each of the diversion blocks is higher at an end of the protrusion than at another end of each of the diversion blocks.

Wherein the perforations are respectively located at the positions of another end of the lower disk adjacent to the diversion blocks.

Wherein the number of the perforations is the same as the number of the fan blades.

Wherein the power unit comprises a motor base, a motor and a rotating shaft, wherein the motor base is mounted on a housing of the hair dryer, the motor is disposed on one side of the motor base, and the rotating shaft is disposed on a side of the motor facing away from the motor base, and the rotating shaft is connected with a side of the lower disk facing away from the upper ring.

Wherein the distance of each of the fan blades apart from each other is the same.

Wherein the airflow generating unit is made of a plastic material.

Wherein a plurality of perforations having the same number is disposed around the rotating shaft corresponding to each of the perforations surroundingly disposed around the protrusion.

According to the above, the present invention achieves one or more of the following effects:

1. The hair dryer deflector provided by the present invention is configured such that by means of the airflow generating unit being driven by the power unit to rotate to generate airflow flowing through each of the perforations to flow toward the power unit and toward the air outlet of the hair dryer, so that the lower temperature airflow generated will reduce the high heat generated by the rotation of the motor, thereby avoiding a situation in which the heating temperature of a heating coil inside the motor cannot be uniformly dissipated.

2. The structure of the hair dryer deflector provided by the present invention is simple and it is easy to be installed on the hair dryer.

DETAILED DESCRIPTION OF THE INVENTION

Figure 3:
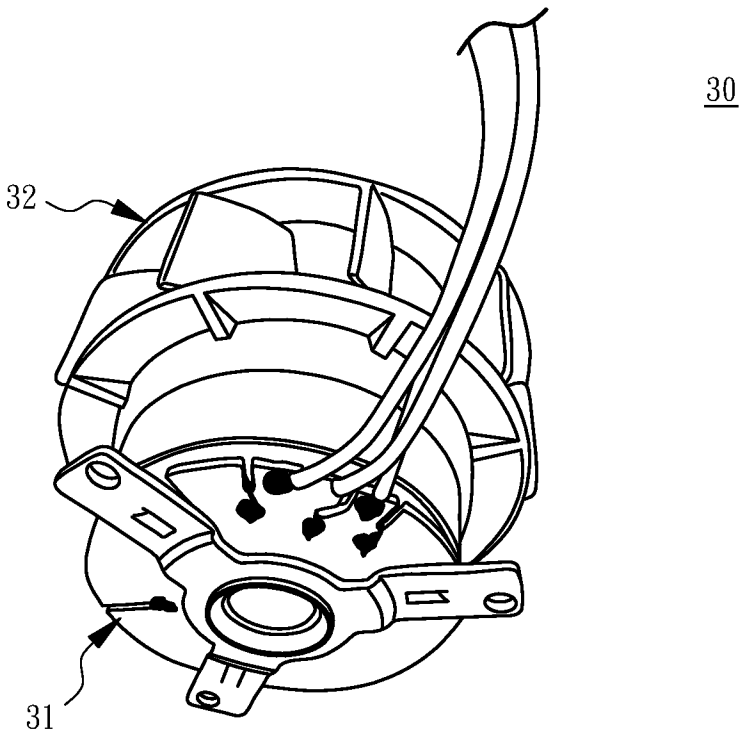
FIG. 3 is a schematic diagram of a hair dryer deflector according to the present invention.
Figure 4:
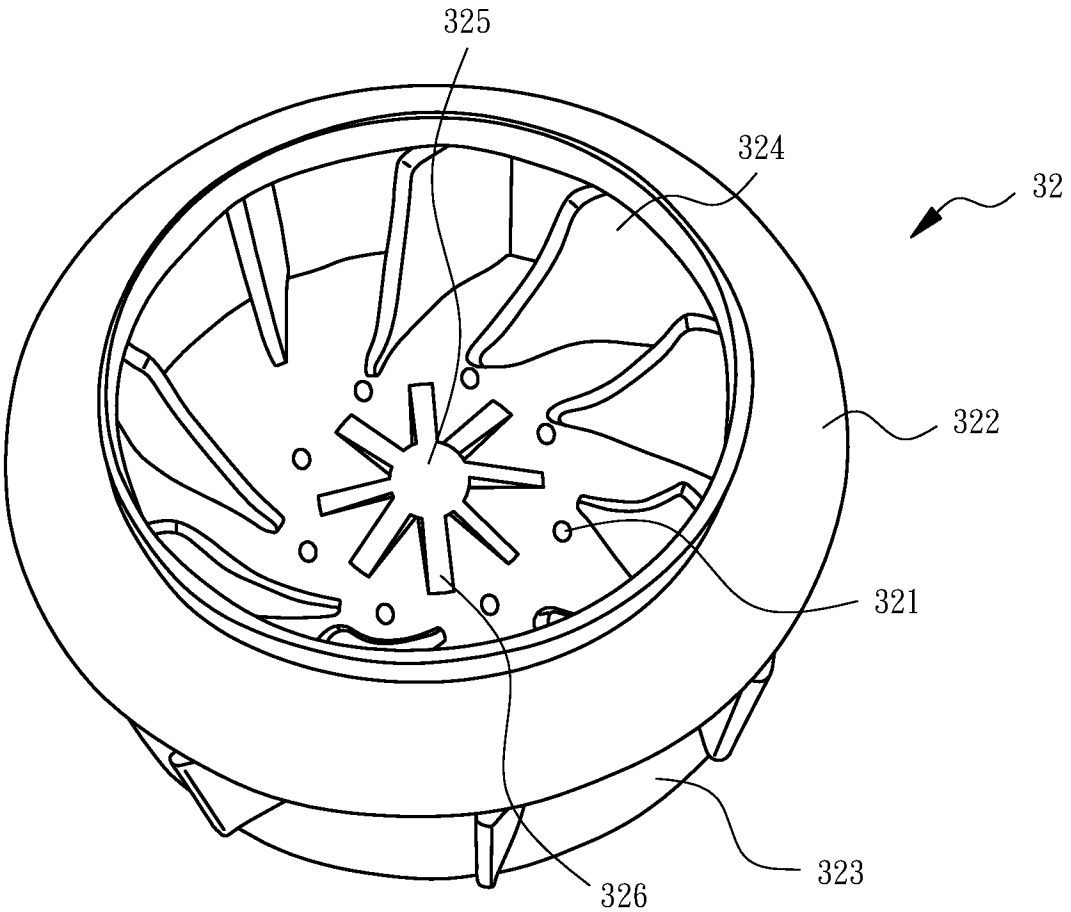
FIG. 4 is a schematic diagram of an airflow generating unit according to the present invention.

Please refer to FIG. 3 and FIG. 4, a deflector 30 made of a plastic material comprises a power unit 31 and an airflow generating unit 32. Wherein the airflow generating unit 32 is connected to one side of the power unit 31, and a plurality of perforations 321 is disposed at the positions of the airflow generating unit 32 relative to the power unit 31. The power unit 31 drives the airflow generating unit 32 to rotate, so that the airflow generated by the airflow generating unit 32 flows through each of the perforations 321 to flow toward the power unit 31 and toward an air outlet of the hair dryer.

The airflow generating unit 32 comprises an upper ring 322, a lower disk 323, and a plurality of fan blades 324. The fan blades 324 are disposed between the upper ring 322 and the lower disk 323, and the distance of each of the fan blades 324 apart from each other is the same, so that the airflow generated by the airflow generating unit 32 can uniformly flow out of the gaps between each of the fan blades 324.

A protrusion 325 is disposed at the center of the lower disk 323, and each of the perforations 321 is surroundingly disposed around the protrusion 325. Wherein the protrusion 325 is disposed with a plurality of diversion blocks 326 radially extending from the center of the lower disk 323.

Each of the diversion blocks 326 is higher at an end of the protrusion 325 than at another end of each of the diversion blocks 326. The disposed positions of the perforations 321 for the lower disk 323 are such that the perforations 321 are respectively located at the positions of another end of the lower disk 323 adjacent to the diversion blocks 326, and the number of the perforations 321 is the same as the number of the fan blades 324.

Therefore, the flow directions of the airflow generated when each of the fan blades 324 is driven to rotate by the power unit 31 are first converged to the radial protrusion 325. Then, the airflow flows into the low end of each of the diversion blocks 326 through the high end of each of the diversion blocks 326, and the airflow is rapidly introduced into each of the perforations 321 through the low end of each of the diversion blocks 326.

Figure 5:
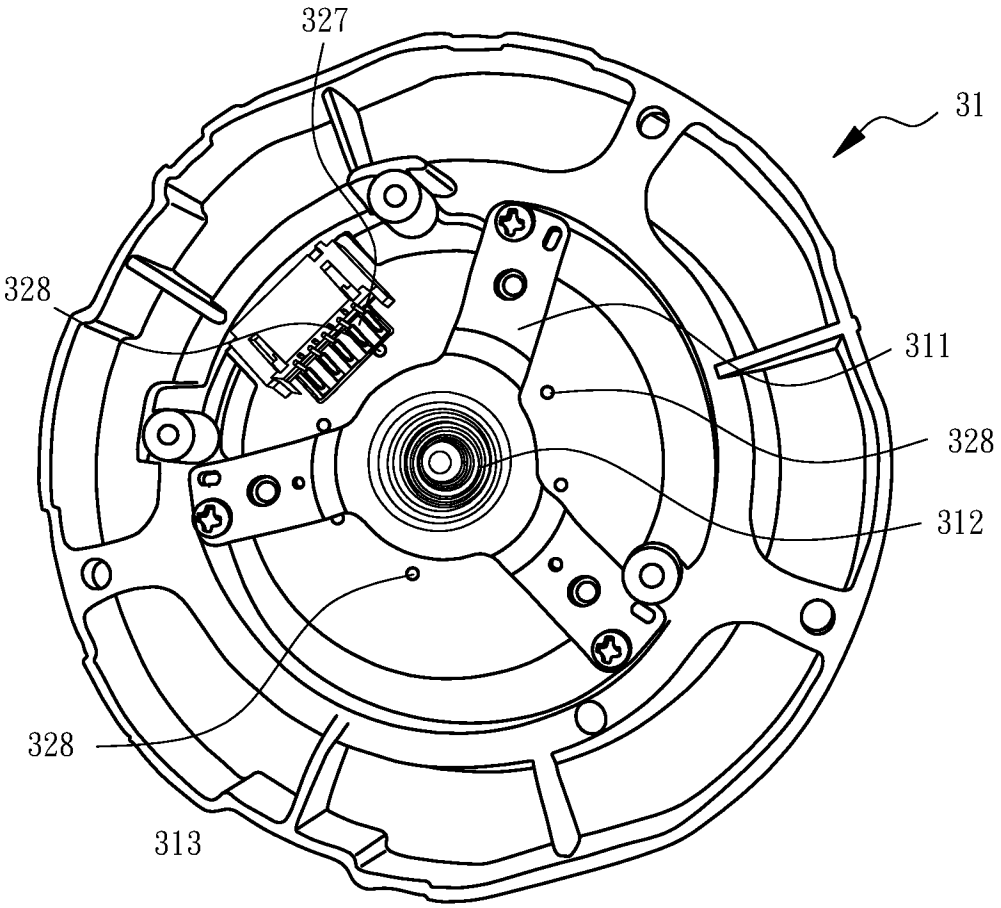
FIG. 5 is a schematic diagram of a power unit according to the present invention.

Please refer to FIG. 5, the power unit 31 comprises a motor base 311, a motor 312 and a rotating shaft 313. Wherein the motor base 311 is mounted on a housing of a hair dryer, and the motor 312 is disposed on one side of the motor base 311. The rotating shaft 313 is disposed on a side of the motor 312 facing away from the motor base 311, and the rotating shaft 313 is connected with a side of the lower disk 323 facing away from the upper ring 322.

In order to introduce the airflow into each of the perforations 321 to reduce the temperature of the motor 312 quickly, a plurality of perforations 328 with an amount the same as the number of the perforations 321 is also disposed around the rotating shaft 313 corresponding to the positions of each of the perforations 321 disposed surroundingly around the protrusion 325. Therefore, the airflow flowed into each of the perforations 321 will reach the surface of the motor 312 via each of the perforations 328, thereby reducing the high heat generated by the rotation of the motor 312.

Figure 1:
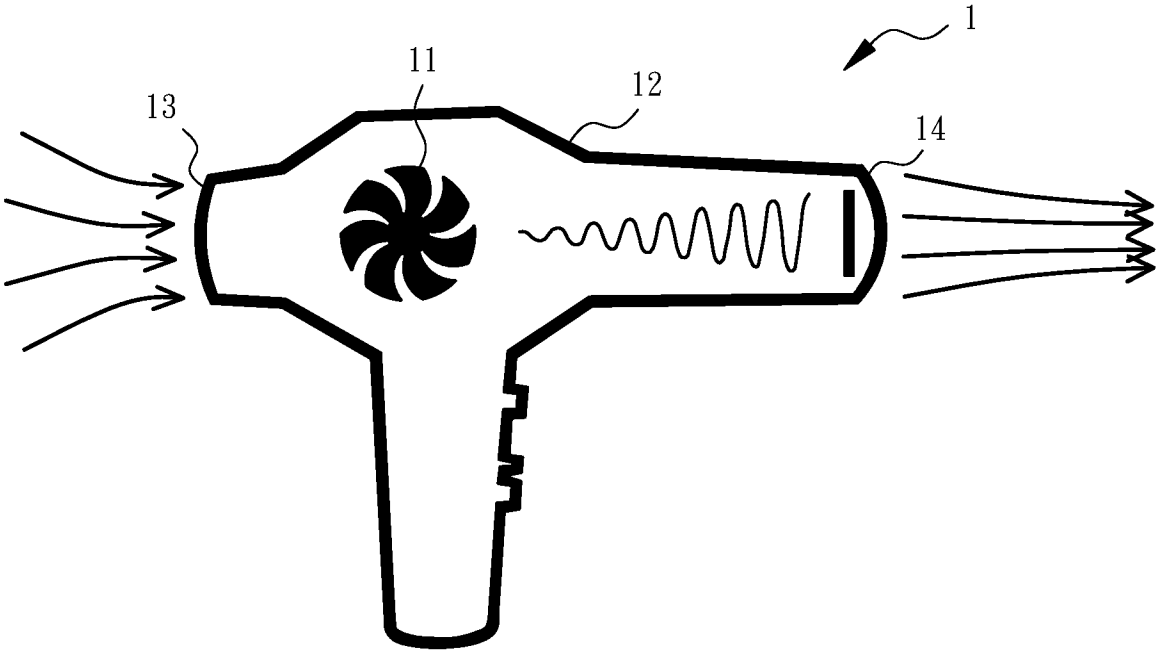
Prior Art FIG. 1
FIG. 1 is a schematic perspective view of the current hair dryer.
Figure 2:
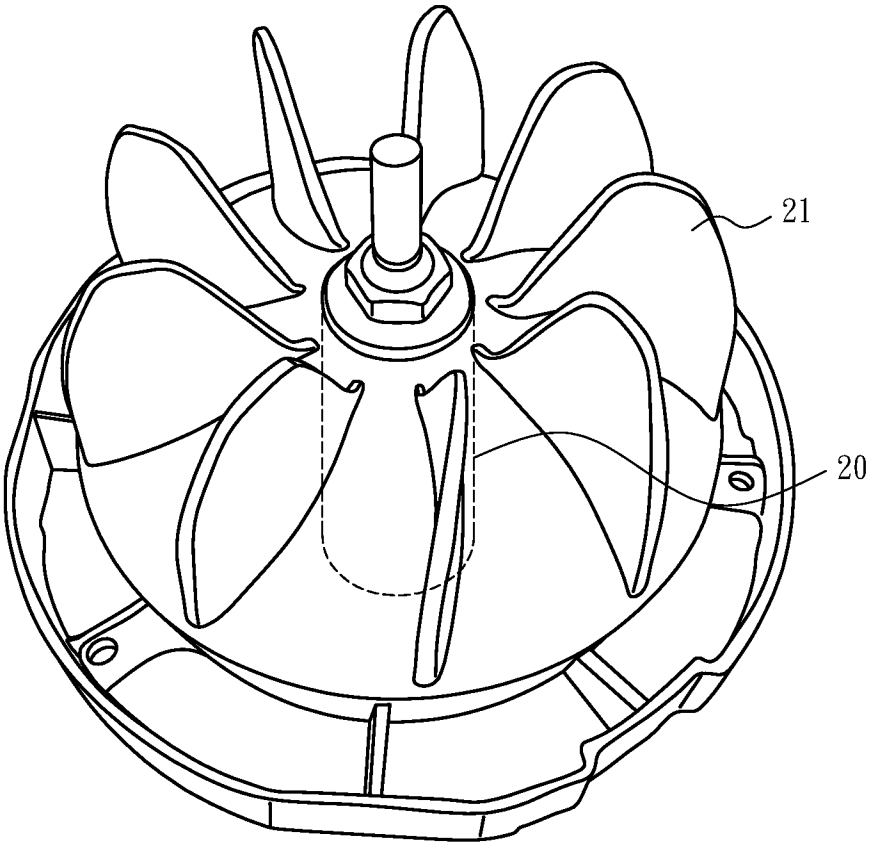
Prior Art FIG. 2
FIG. 2 is a schematic diagram of a connection between a conventional hair dryer vertical motor and fan blades.

In summary, when the hair dryer 1 of FIG. 1 is needed to dry or shape the hair, in FIG. 5, the motor 312 disposed on one side of the motor base 311 receives an external power through a power cable 327, then the power generated by the motor 312 drives the rotating shaft 313 to rotate, so that the lower disk 323 connected to the rotating shaft 313 also correspondingly and synchronously rotates. Thus the fan blades 324 disposed between the upper ring 322 and the lower disk 323 rotate to generate airflows, the airflows not only uniformly pass through the gaps between each of the fan blades 324, but also converge at the radial protrusion 325 and are introduced from the high end to the low end of each of the diversion blocks 326. Then, the airflows flow through each of the perforations 321 and each of the perforations 328 to flow toward the surface of the motor 312 and toward an air outlet 14 of the hair dryer 1.

Therefore, the cooling air generated by the rotation of the fan blades 324 flows through the above-mentioned path to the surface of the motor 312 to reduce the high heat generated by the rotation of the motor 312, thereby avoiding a situation in which the heating temperature of a heating coil inside the motor 312 cannot be uniformly dissipated.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A hair dryer deflector, comprising:

a power unit; and an airflow generating unit, comprising an upper ring, a lower disk, a plurality of fan blades and a plurality of first perforations, the airflow generating unit being connected to one side of the power unit, the airflow generating unit being driven by the power unit to rotate to generate airflow, and the airflow passing through each of the first perforations to flow toward the power unit and toward an air outlet of a hair dryer, wherein the fan blades are disposed between the upper ring and the lower disk, a protrusion is disposed at the center of the lower disk, and the first perforations are surroundingly disposed around the protrusion.

2. The deflector as claimed in claim 1, wherein the protrusion is disposed with a plurality of diversion blocks radially extending from the center of the lower disk, and each of the diversion blocks is higher at an end of the protrusion than at another end of each of the diversion blocks.

3. The deflector as claimed in claim 2, wherein the first perforations are respectively located at positions of another end of the lower disk adjacent to the diversion blocks.

4. The deflector as claimed in claim 3, wherein the number of the first perforations is the same as the number of the fan blades.

5. The deflector as claimed in claim 1, wherein the power unit comprises:

a motor base for mounting on a housing of the hair dryer;

a motor disposed on one side of the motor base; and a rotating shaft disposed on a side of the motor facing away from the motor base, and the rotating shaft is connected with a side of the lower disk facing away from the upper ring.

6. The deflector as claimed in claim 1, wherein the distance of each of the fan blades apart from each other is the same.

7. The deflector as claimed in claim 1, wherein the airflow generating unit is made of a plastic material.

8. The deflector as claimed in claim 5, wherein a plurality of second perforations having the same number as the first perforations are disposed around the rotating shaft corresponding to positions of the first perforations surroundingly disposed around the protrusion.

* * * * *